US008215319B2

(12) United States Patent
Couillard

(10) Patent No.: US 8,215,319 B2
(45) Date of Patent: Jul. 10, 2012

(54) HAIRBRUSH

(75) Inventor: Lucie Couillard, Bedford (CA)

(73) Assignee: 9211-5716 Quebec Inc., Bedford, Quebec (CA)

( * ) Notice: Subject to any disclaimer, the term of this patent is extended or adjusted under 35 U.S.C. 154(b) by 226 days.

(21) Appl. No.: 12/457,271

(22) Filed: Jun. 5, 2009

(65) Prior Publication Data

US 2010/0307519 A1 Dec. 9, 2010

(51) Int. Cl.
*A45D 6/02* (2006.01)
*A47L 23/02* (2006.01)
*A46B 7/04* (2006.01)

(52) U.S. Cl. ..... 132/238; 15/27; 15/176.1

(58) Field of Classification Search ..... 132/107, 132/120, 123, 200, 237, 238, 239, 265, 119.1, 132/12, 122, 151, 223, 226, 240, 241, 255, 132/266; 15/207.2, 23, 25–27, 176.1, 176.6; 206/581; 219/222–226, 230, 244; 119/611, 119/612, 613, 615, 627, 664
See application file for complete search history.

(56) References Cited

U.S. PATENT DOCUMENTS 3,386,453 A * 6/1968 Roberts et al. ..... 132/119.1
3,413,984 A * 12/1968 Tracy et al. ..... 132/238
3,893,425 A * 7/1975 Lapres ..... 119/609
3,909,868 A * 10/1975 Nogues ..... 15/27
3,947,910 A * 4/1976 Akerman ..... 15/27
4,197,608 A 4/1980 Holley et al.
4,469,934 A * 9/1984 Isshiki et al. ..... 219/222
4,671,304 A * 6/1987 Tomohiro ..... 132/240
4,944,319 A * 7/1990 Trombley ..... 132/238
5,412,828 A 5/1995 Kuhlmey et al.
5,649,555 A * 7/1997 Harris ..... 132/238
5,799,670 A * 9/1998 Rondeau ..... 132/210
5,992,423 A * 11/1999 Tevolini ..... 132/200
6,029,307 A * 2/2000 Baudoin ..... 15/145
6,070,594 A * 6/2000 Mears ..... 132/123
6,098,635 A * 8/2000 Marino ..... 132/238
6,230,716 B1 * 5/2001 Minoletti ..... 132/226
6,725,495 B1 4/2004 Habibi
7,198,048 B2 * 4/2007 Johnson ..... 132/125
7,296,580 B1 * 11/2007 Sbardella ..... 132/122
7,377,001 B2 * 5/2008 McKay ..... 15/23
2005/0263168 A1 * 12/2005 De Laforcade ..... 132/266
2008/0098541 A1 5/2008 Stydahar
2009/0229624 A1 * 9/2009 Purvis et al. ..... 132/120
2009/0272393 A1 * 11/2009 Stydahar ..... 132/200
2010/0236571 A1 * 9/2010 Haziza ..... 132/210

* cited by examiner

*Primary Examiner* — Todd Manahan
*Assistant Examiner* — Tatiana Nobrega
(74) *Attorney, Agent, or Firm* — Equinox Protection Inc.; Franz Bonsang, Patent Agency

(57) ABSTRACT

A hairbrush for styling hair has a brush head releasably connected to a rod rotatably mounted on a handle portion of the hairbrush and having a handle. The brush head has a plurality of spaced apart bristles for insertion between strands of the hair and gripping the strands therebetween. As the rod, and therefore the brush head are rotatable relative the handle, the brush head, with strands of hair gripped thereon, can be rotated as the handle is moved towards the head of a person whose hair is being styled, thus causing the strands of hair to be rolled around brush head, without requiring cumbersome twisting of the handle. A spring facilitates rotation in an opposite second direction and unrolling of the strands of hair off the brush head. A locking pin enables locking and unlocking of the rod and brush head to prevent and enable rotation thereof.

17 Claims, 3 Drawing Sheets

HAIRBRUSH

FIELD OF THE INVENTION

The present invention is related to hairbrushes, and is more particularly directed to a hairbrush having a rotatable brush head.

BACKGROUND OF THE INVENTION

It is well known in the art to use hairbrushes to style and brush hair of a person. Typically, most conventional hairbrushes have a handle, which is grasped by a user in the user's hand, and a brush head having teeth or bristles which are placed in the hair and then moved through the hair to brush and style, for example curl or wave, the hair. Conventionally, for styling of hair that involves curling of the hair, a hairbrush having a cylindrically shaped brush head with circumferentially spaced apart bristles or teeth is used. In such cases, the brush head is, typically, inserted between hair ends of a plurality of strands of hair, with the hair ends grippingly retained or bunched between the bristles or teeth. The user then rotates or twists the handle towards the scalp or head of the person whose hair is being styled to roll the plurality of strands around the brush head, preferably between the teeth or bristles. Once the strands are rolled to a desired thickness or position on the strands, heat may be applied, for example by using a hair dryer to the strands to dry them. The handle is then twisted in the opposite direction away from the person's head or scalp to release the hair from the bristles or teeth, the dried strands forming waves or curls due to the rolling and application of heat.

Alternatively, instead of using a hairbrush, hair curlers may be deployed in which case the hair ends are placed between bristles or teeth on the curlers and the curlers are rolled towards the person's head. The curlers may then be fixed in place at the desired position, for example using conventional hairpins or the like. Heat is then applied and the curlers are unrolled, as with conventional hairbrushes.

Unfortunately, for conventional hairbrushes during curling of hair, the rolling of the strands of hair around the brush head towards and away from the head requires that the user rotate the handle for each rotation. This rotation of the handle may cause uncomfortable strain and injury of the wrist of the hairstylist, i.e. the person effecting the styling. Rotation of conventional hair curlers during curling may cause similar strain. Further, depending on the size of the curls or waves desired, a large variety of hairbrushes may be required, as the size of the curls and waves is related to the size, and notably the circumference, of the brush head.

Accordingly, there is a need for an improved hairbrush for brushing and curling hair.

SUMMARY OF THE INVENTION

It is therefore a general object of the present invention to provide an improved hairbrush for brushing and curling hair of a subject person.

An advantage of the present invention is that the hairbrush provided by the present invention reduces strain on a hairstylist's wrist during curling of hair.

Another advantage of the present invention is that the hairbrush easily be used to create curls and waves of different sizes.

A further advantage of the present invention is that the hairbrush may be used both for curling and for simple brushing of hair.

According to an aspect of the present invention, there is provided a hairbrush for brushing and curling hair on a head of a subject person, the hairbrush comprising:

- a handle portion having a handle sized and shaped for grasping by the hand of a hairstylist effecting the brushing and curling; and
- a brush head extending axially outwardly away from a first handle end of the handle on an axis defined thereby and having outwardly extending bristles for insertion between strands of the hair and gripping thereof, the brush head being rotatable in a first direction relative the handle by application of a force on the handle towards the head with a plurality of the strands gripped by the bristles proximal respective strand ends thereof to roll the plurality of strands around the brush head to style the plurality of strands.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
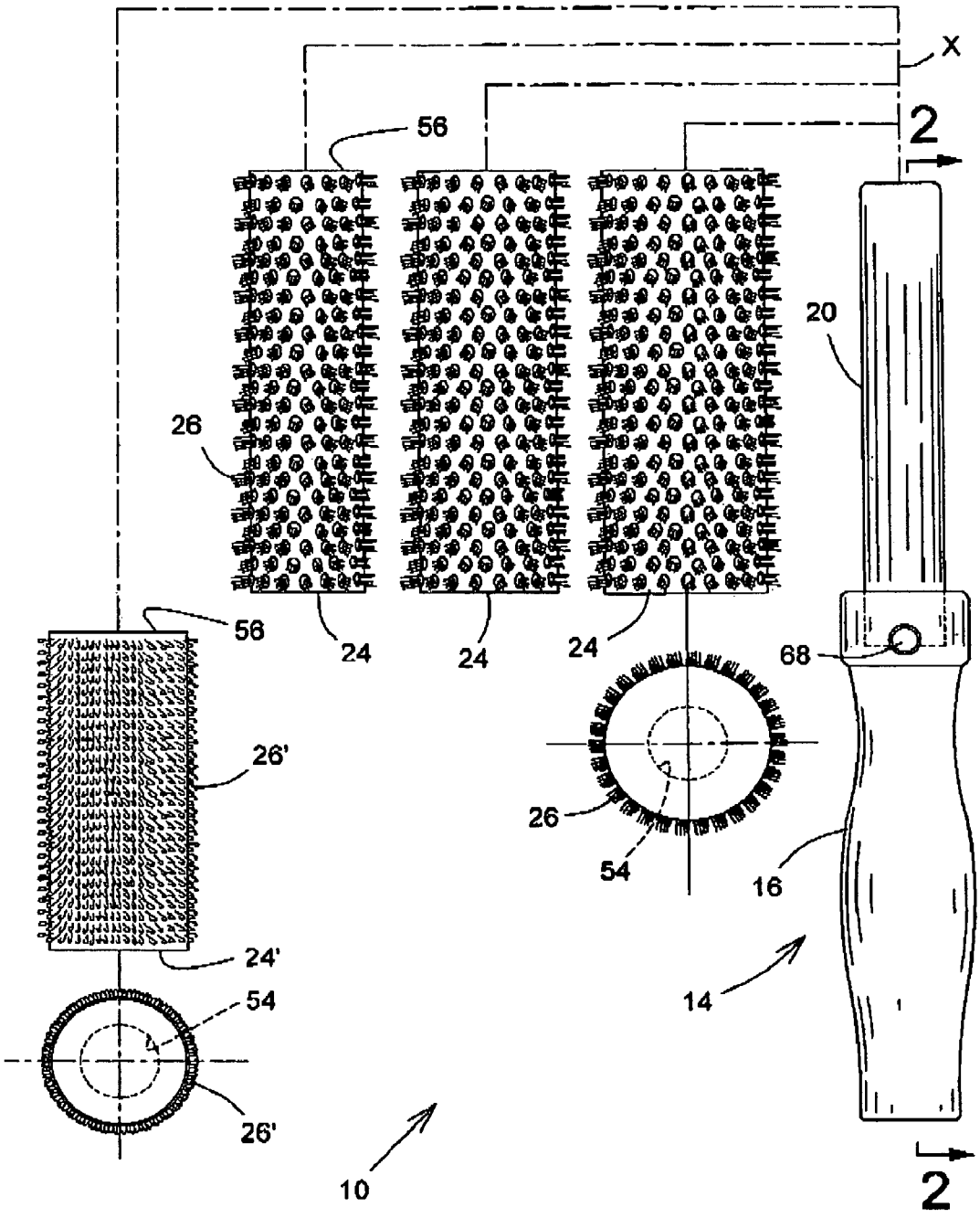
FIG. 1 is a side elevational view of a top perspective view of an embodiment of a hairbrush in accordance with the present invention.
Figure 2:
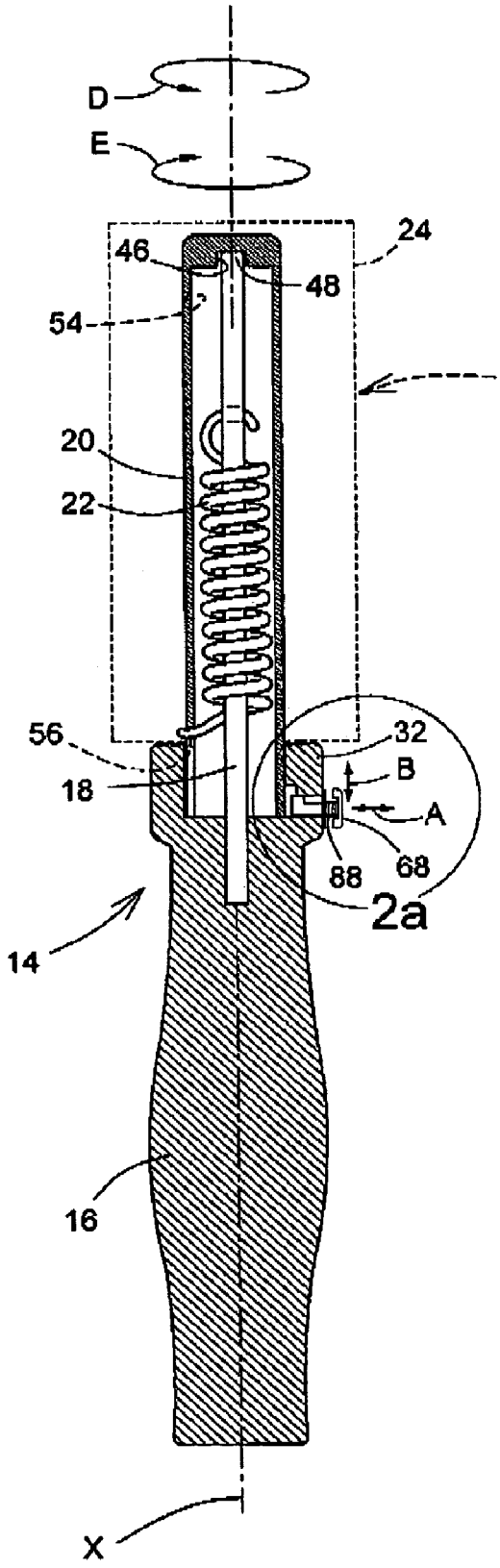
FIG. 2 is a sectional view of the hairbrush shown in FIG. 1, taken along line 2-2 of FIG. 1.
Figure 3:
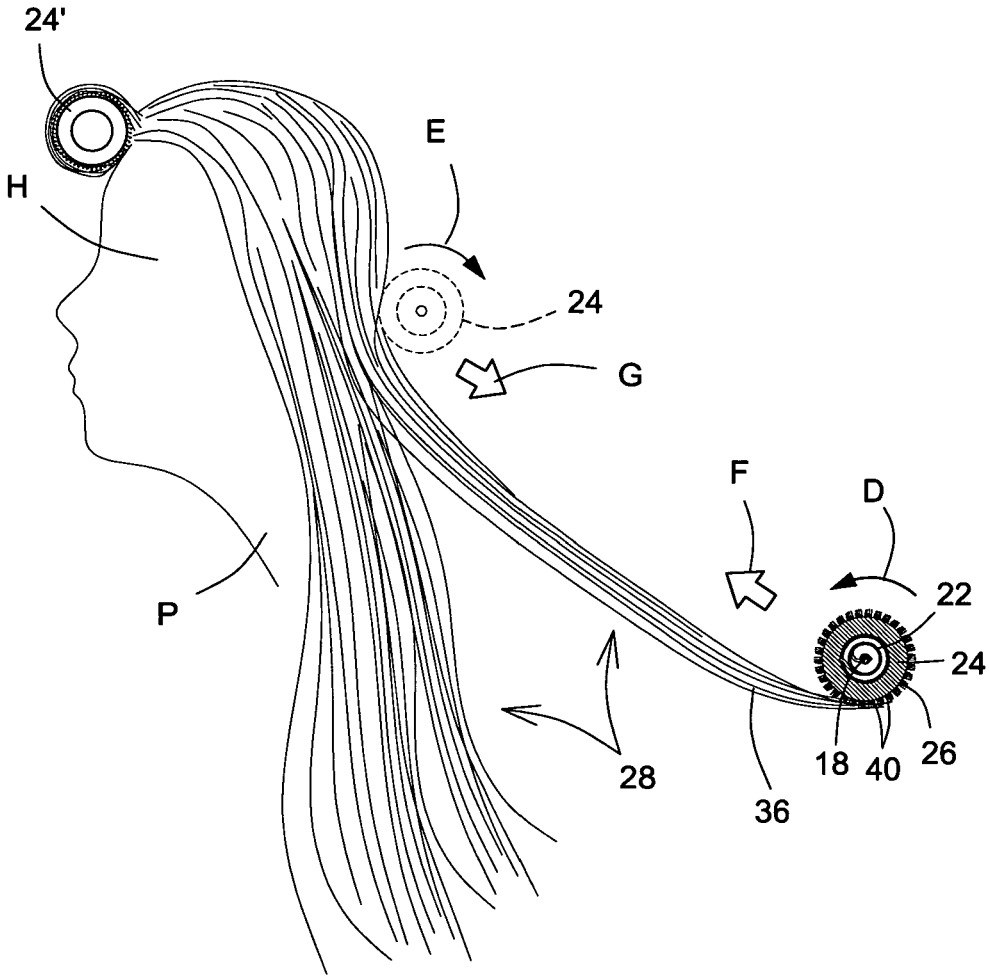
FIG. 3 is a top plan view of the hairbrush shown in FIG. 1, illustrating use of the hairbrush to style hair of a person.

Referring to FIGS. 1, 2, and 3, there is shown an embodiment of a hairbrush, shown generally as 10, for brushing and curling hair, shown generally as 28, of a subject person P. The brush 10 includes a handle portion, shown generally as 14, having a handle 16 and an elongate member 18, a rod 20 rotatably mounted on the elongate member 18, and a brush head 24 having a plurality of outwardly extending teeth or bristles 26 adapted for insertion between and gripping of strands 36 of hair 28 of the person P. The elongate member 18, preferably threaded and cylindrical in shape, is fixedly attached in a fixed position to a proximal first handle end 32 of the handle 16 and extends axially outwardly therefrom along an axis X defined by the handle 16. Similarly, the rod 20 rotatably mounted on the elongate member 18 also extends axially outwardly from the proximal first handle end 32 along axis X around which the rod 20 is rotatable. The brush head 24 is connected to, i.e. mounted on, the rod 20, and thereby also extends axially away from the first handle end 32. The brush head 24 is, therefore, also rotatably connected to the handle 16 and rotatable relative the handle 16 about axis X.

Referring now to the mounting of the rod 20 on the elongate member 18, as shown in FIG. 2, the rod 20 has a member recess 46 into which a distal member end 48 of the elongate member 18 is inserted. Further, the distal member end 48 and member recess 46 are sized and shaped such that the rod 20 is freely rotatable around axis X around when the distal member end 48 is engaged in the member recess 46. To ensure that the rod 20 does not become disconnected from the member 18, the rod 20 is connected to the elongate member 18 of the handle portion 14 by spring 22, which resiliently retains the rod 20 on the member 18. More specifically, a first spring end 44 of the spring 22 is connected to the elongate member 18 and a generally longitudinally opposed second spring end 44 is connected to the rod 20. To provide support for the spring 22, the spring 22 is preferably coiled around the elongate member 18, with the elongate member 18 extending therethrough.

As best shown in FIG. 3, when the bristles 26 are inserted between a plurality of strands 36 of hair 28, the brush head 24, rotatably mounted on member 18, is rotatable in a first direction D relative the handle 16 by simple application, without twisting of the handle 16, of a force, shown as arrow F, on the handle 16 towards the head H of the person P. Similarly, the brush head 24 is rotatable in a second direction E, opposite the first direction D, relative the handle 16 by application of a force, shown as arrow G, away from the head H, also without twisting of the handle 16. Thus, by inserting the bristles 26 into the strands 36 of hair 28 proximal strand ends 40 thereof such that the strand ends 40 are gripped between the bristles 36, a user may then, without cumbersome twisting of the handle 16, move the handle 16 towards the person's head H to cause the brush head 24 to rotate in a first direction D and thereby roll the strands 36 in the first direction D around the brush head 24. Once the strands 36 are rolled around the brush head 24 to an extent or position desired, heat may be applied to at least partially dry the strands 36 and to form curls or waves therein. After the heat is applied, the strands 36 may be effortlessly disengaged from the brush head 24 by moving the handle 16, again without twisting thereof, away from the head H to cause the brush head 24 to rotate in the second direction E, thus unrolling the strands 36. Accordingly, the hairbrush 10 enables styling, e.g. curling or waving, of the hair 28, without requiring the constant twisting of that is typically necessary with conventional hairbrushes or curlers and which may cause harmful wrist train. Advantageously, as the hairbrush 10 is moved towards the head H with the bristles 26 engaged in the strands 36, the rotation of the rod 20 and brush head 24 also causes the spring 22 to be wound in the first direction D. Thus, after application of heat to curl or wave the strands 36, and the force holding the hairbrush in position is removed, the spring 22 automatically biases the rod 20 and brush head 24 in the second direction E to facilitate removal of the brush head 24 from the strands 36.

Referring again to FIGS. 1 and 2, the brush head 24 has an outer head surface 50, preferably cylindrical in shape. The bristles 26 extend outwardly from the outer head surface 50 and are preferably organized into bunches, shown generally as 52, substantially equally, and circumferentially, spaced apart relative one another. Alternatively, the bristles 26 may simply be single bristles 26, preferably equally and circumferentially spaced apart from one another. In either case, the bristles 26 and bunches 52 must be sufficiently close to one another that they can grip the hair 28 during styling thereof. Further, the bristles 26 and bunches 52 are preferably equally spaced apart around the outer head surface 50 along the entire length thereof.

Referring still to FIGS. 1 and 2, the brush head 24 is mounted on the rod 20 with the rod 20 matingly inserted into a cavity 54 of the brush head 24, the cavity 54 extending inwardly from an open end 56 of the brush head 24. More specifically, the cavity 54 and rod 20, both preferably cylindrical in shape, are sized and shaped for mating insertion into the cavity 54, such that the rod 20 grippingly abuts against the brush head 24 in the cavity 54. Preferably, the rod 7, 20 and cavity 54 are further sized and shaped such that the brush head 24 may be removed from the brush 10 by axial withdrawal of the rod 20 from the cavity 54, thereby providing releasable connection of the brush head 24 to the rod 20. Thus, a variety of brush heads 24 of variable dimensions and distributions of teeth may be connected to the rod 20 to provide a large variety of hair styling options for curling, brushing, and waving the hair 28. In particular, the brush head 24 may also be a hair roller 24, having conventional bristles 26, which is rolled through the hair on the handle 16, as described above, until a desired position or thickness of hair 28 rolled thereon is attained, and then removed from the handle 16 and rod 20 and fixed in position with a conventional hairpin, not shown. Heat may then be applied, as described above, to curl or wave the hair 28 on the roller 24 and the roller 24 removed. Alternatively, brush head 24' may be a Velcro®-like hair roller 24', identical to brush head 24, except that, instead of having conventional bristles 26, the Velcro® hair roller has Velcro®, a well-known hook and loop fastener, on the outer surface 50 thereof, the Velcro® providing hook-type bristles 26' in place of conventional bristles 26.

Figure 2A:
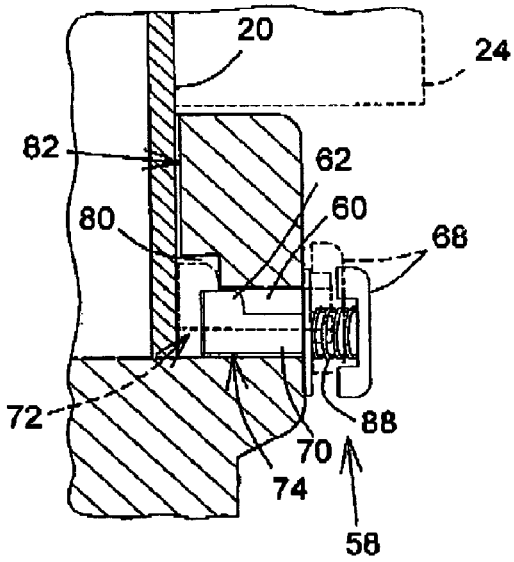
FIG. 2*a* is an enlarged partial sectional view of the hairbrush taken along line 2*a* of FIG 2.

Reference is now made to FIGS. 2 and 2*a*. Optionally, but preferably, the hairbrush also includes a locking pin 58 mounted in pin channel 60 extending through the handle 16 proximal the rod 20. The locking pin 58 includes a flange 62 at a first pin end thereof disposed proximal the rod 20, a pin head 68 at a generally opposed second pin end thereof, disposed outside of the handle, and a pin shaft 70 extending between said the pin head 68 and flange 62 at the pin ends. The locking pin 58 is extendible towards, and retractable away from, the rod 20 with the pin shaft 70 extending through the pin channel 60, between locked and unlocked configurations therefor. In the locked configuration, shown generally as 72, the first pin end and the flange 62 are extended by application of an inwardly directed force towards the rod 20 and abut against the rod 20 to prevent rotation of the rod 20 and the brush head 24 mounted thereon. Thus, when the pin 58 in the locked configuration 72, the hairbrush 10 may be used in a conventional manner to brush hair 28 in that movement of the brush head 24 through the hair 28 will not cause rotation of the brush head 24. Further, a hairstylist styling the hair 28 may wish to extend the pin 58 into the locked configuration 72 during curling or waving of the strands 36 of hair 28, as described above, once the strands 36 are rolled around the brush head 24 to a desired position or thickness. In this fashion, the hairstylist can then apply heat to the strands 36 without having to constantly exert a force to maintain the brush head 24 in place, particularly against resilient action of spring 22. From the locked configuration 72, the locking pin 58 may be retracted or withdrawn into the unlocked configuration 74, in which the flange 62 and first pin end are spaced apart from the rod 24, thus allowing the rod 20 and brush head 24 to rotate.

To ensure the locking pin 58 can be easily retained in the locked configuration 74, the handle 16 has a handle recess 80 into an inner handle wall 82 adjacent the pin channel 60 and the rod 20. The handle recess 80 and flange 62 are sized and shaped for releasable insertion of the flange 62 into the handle recess 80 when the flange 62 and first pin end abut against the rod 20 in the locked configuration 72. Thus, the flange 62, when inserted into in the handle recess 80, retains the locking pin 58 in the locked configuration 72. To facilitate movement of the locking pin 58 between the locked and unlocked configurations 72, 74, the pin shaft 70 and pin channel 60 are sized and shaped for enabling upward and downward tilting movement of the pin shaft 70, for example as shown by arrow B, by upward and downward tilting movement of the pin head 68, during extension and retraction of the pin shaft 70, for example as shown by arrow A, through the pin channel 60. The upward and downward tilting movement of the pin head 68 and shaft 70, in turn, cause the flange 62, when aligned with the recess 80, to move up and down into and out of the handle recess 80 to respectively retain the locking pin 58 in the locked configuration 72 and release the locking pin 58 into the unlocked configuration 74.

A locking pin spring 88 is mounted on the pin shaft 70 and extends thereon between the pin head 68 and the handle 16. The locking pin spring 88 is compressed between the head 68 and the handle 16 by application of the inwardly directed force when the locking pin 58 is extended into the locked configuration 72. Conversely, the locking pin spring 88 biases the locking pin 58 outwardly away from the rod 20 towards the unlocked configuration 72 once the inwardly directed force is removed and the flange 62 is disengaged from the handle recess 80, as described above. Thus, the locking pin 58 is resiliently spring mounted on the handle 16 through the pin channel 60.

Although the present hairbrush has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A hairbrush for brushing and styling hair on a head of a subject person, said hairbrush comprising:

a handle portion having a handle sized and shaped for grasping by the hand of a hairstylist;

a brush head extending axially outwardly away from a proximal handle end of said handle on an axis defined thereby and having outwardly extending bristles for insertion between strands of the hair and gripping thereof, said brush head being rotatable in a first direction relative said handle by application of a force on said handle towards the head with a plurality of said strands gripped by said bristles proximal respective strand ends thereof to roll said plurality of strands around the brush head to style said plurality of strands;

a rod extending axially outwardly from said proximal handle end and rotatably mounted thereon for rotation around said axis, said brush head being mounted on said rod and thereby rotatably connected to said handle;

a elongated member extending axially outward from said proximal handle end along said axis and fixedly attached thereto, said rod being rotatably mounted on said elongated member; and a spring connected to and housed entirely within said rod wherein said spring has first and second spring ends, said first spring end being connected to said elongated member and said second spring end being connected to said rod; said spring being resiliently wound in said first direction by said force as said brush head and said rod rotate in said first direction during rolling of said strands towards the head, said spring resiliently unwinding when said force is withdrawn and thereby rotating said brush head and said rod in an opposite second direction and unrolling said plurality of said strands.

2. The hairbrush of claim 1, wherein said rod comprises a cavity extending longitudinally inwardly from a open end of said rod, said rod and said cavity being dimensioned for mating insertion of said rod into said cavity for rotatably connecting said brush head to said handle.

3. The hairbrush of claim 2, wherein said rod and said cavity are cylindrical in shape.

4. The hair brush of claim 1, wherein said elongated member is cylindrical in shape.

5. The hairbrush of claim 4, wherein said spring is connected to said elongated member, said spring retaining said rod on said elongated member.

6. The hairbrush of claim 5, wherein said spring is coiled around said elongated member.

7. The hairbrush of claim 1, wherein said brush head has an outer head surface that is substantially circumferential in shape.

8. The hairbrush of claim 1, wherein said bristles are organized into plurality of spaced apart bunches of said bristles.

9. The hairbrush of claim 1, wherein said bristles are substantially equally spaced apart relative one another.

10. The hairbrush of claim 8, wherein said bunches are substantially equally spaced apart relative one another.

11. The hairbrush of claim 1, wherein said brush head is releasably connected to said rod.

12. The hairbrush of claim 2, wherein said rod and said cavity are further dimensioned for removal of said brush head by axial withdrawal of said rod from said cavity, said brush head being thereby releasably connected to said rod.

13. The hairbrush of claim 1, further comprising a locking pin mounted in a pin channel extending through the handle proximal the rod, the locking pin being extendible towards said rod through the pin channel into a locked configuration, in which the locking pin and prevents rotation of the brush head by abutting against the rod, and retractable away from the rod into an unlocked position in which the pin is spaced apart from said rod, for enabling rotation of said rod and said brush head.

14. The hairbrush of claim 13, said locking pin comprising a flange at a first pin end thereof disposed proximal the rod, and a pin head at a generally opposed second pin end thereof, disposed outside of the handle, and a pin shaft extending between said pin ends and movable back and forth through said channel, said first pin end and said flange abutting said rod in said locked configuration.

15. The hairbrush of claim 14, said handle having a recess in an inner handle wall adjacent said pin channel, said recess and said flange being sized and shaped for releasable insertion of said flange into said recess with said flange and said first pin end abutting the rod to retain the locking pin in said locked configuration.

16. The hairbrush of claim 15, wherein said pin shaft and said channel are sized and shaped for enabling upward and downward tilting movement of said pin shaft by upward and downward movement of said pin head during extension and retraction of said pin shaft to tilt said flange into and out of said recess to respectively retain said locking pin in said locked configuration and release said locking pin into said unlocked configuration.

17. The hairbrush of claim 16, further comprising a locking pin spring mounted on the locking pin and extending between the pin head and the handle, said locking pin spring being compressed between said head and said handle when said locking pin is in said locked configuration and biasing said locking pin outwardly away from said rod towards said unlocked configuration.

* * * * *